United States Patent [19]

Cronkhite et al.

[11] Patent Number: 4,680,893

[45] Date of Patent: Jul. 21, 1987

[54] APPARATUS FOR POLISHING SEMICONDUCTOR WAFERS

[75] Inventors: Paul W. Cronkhite, Scottsdale; Bruce C. Bosley, Mesa; James H. Jones, Phoenix; Asit G. Patel, Chandler, all of Ariz.

[73] Assignee: Motorola, Inc., Schaumburg, Ill.

[21] Appl. No.: 779,339

[22] Filed: Sep. 23, 1985

[51] Int. Cl.[4] ..... B24B 7/04

[52] U.S. Cl. ..... 51/5 R; 51/131.3; 51/131.5; 51/326; 51/283 R; 51/235

[58] Field of Search ..... 51/5 R, 165.71, 134, 51/131.3, 236, 326, 327, 283 R, 235, 131.5, 5 D, 281.5 R, 124 R

[56] References Cited

U.S. PATENT DOCUMENTS

| | | | |
|---|---|---|---|
| 3,858,369 | 1/1975 | Dolgov et al. | 51/215 AR |
| 4,002,246 | 1/1977 | Brandt et al. | 51/235 |
| 4,141,180 | 2/1979 | Gill, Jr. et al. | 51/5 R |
| 4,239,567 | 12/1980 | Winnings | 51/237 R |
| 4,484,413 | 10/1985 | Yamamoto et al. | 51/165.71 |

*Primary Examiner*—Frederick R. Schmidt
*Assistant Examiner*—Bradley I. Vaught
*Attorney, Agent, or Firm*—Joe E. Barbee

[57] ABSTRACT

An apparatus for polishing semiconductor material is described in which a movable polishing arm is mounted to a cabinet. Connected to the polishing arm is a workpiece holder or sometimes referred to as a wafer chuck. Adjacent to the polishing arm is a load station which positions the wafer for pick-up by the polishing arm and attached wafer chuck. Mounted to the cabinet, next to a brush station, is a primary polish station which is used to remove the majority of the material. Alongside of the primary polish station is a final polish station used to provide a finished surface to the wafer. The polishing arm discharges the polished wafer into an unload station which is located next to the final polish station.

6 Claims, 5 Drawing Figures

APPARATUS FOR POLISHING SEMICONDUCTOR WAFERS

BACKGROUND OF THE INVENTION

This invention relates, in general, to semiconductor wafer processing equipment, and more particularly to an apparatus for polishing a semiconductor wafer made of silicon or other material that is used in the fabrication of a semiconductor device.

Semiconductor devices are manufactured on a substrate which is usually made from silicon or the like. The substrate or wafers, are sliced from ingots of various sizes. This slicing process causes surface damage and leaves the wafer with thickness variations and deviations from parallelism. To improve the wafer flatness and parallelism and eliminate saw marks and surface damage, the wafers are sent through a lapping or grinding, and an etching and polishing process.

The rough surface of a lapped wafer is usually etched to remove subsurface damage, then polished to a flat mirror finish before the wafer is suitable for processing into semiconductor devices. The polished wafer must be free from defects and be extremely flat, especially when the wafer is used for sub-micron devices.

Polishing wafers is usually a two part process in which the first part, or primary polish is stock removal, approximately 17 micrometers of material are removed from each wafer. The next step is final polishing, where only a very small amount of material remains to be removed. Both primary polish and final polish are done on the same type of machine but with different slurries and pads. Since final polishing takes only about twenty percent of the time that primary polishing takes, there may be four or five primary polishing machines for each machine used for final polishing.

It was found that the existing polishing equipment was not capable of producing the high quality flat finish that is necessary in the starting material of a sophisticated integrated circuit. It was also found that over two percent of the wafers were damaged due to the manual handling of the wafers during the unloading of the primary polisher, transporting the wafers, and loading the final polisher.

A need therefore existed for an automatic polishing system that could do both the primary and the final polish and still produce large diameter, ultra flat, defect free wafers, with a minimum amount of operator handling.

SUMMARY OF THE INVENTION

Accordingly, it is an object of the present invention to provide an improved apparatus for polishing a semiconductor wafer or a workpiece.

Another object of this invention is to decrease or eliminate rejected wafers due to defects or breakage.

An additional object of the present invention is to polish a semiconductor wafer to a high degree of precision, accuracy, and flatness control.

Yet a further object of the present invention is to provide a polishing apparatus that is computer controlled.

The foregoing and other objects and advantages are achieved in the present invention which, as part thereof, makes use of a servo driven polishing arm that is mounted to a cabinet. Connected to the polishing arm is a workpiece holder, sometimes referred to as a wafer chuck. Adjacent to the polishing arm is a load station which positions the work piece or wafer for pick-up by the polishing arm and attached wafer chuck. Next to the load station is a brush station which automatically cleans the grooves in the wafer chuck prior to picking up the next wafer. Mounted to the cabinet, next to the brush station, is a primary polish station which is used to remove the majority of the rough material. Alongside of the primary polish station is a final polish station used to provide a finished surface to the wafer. The polishing arm discharges the polished wafer into an unload station which is located next to the final polish station.

A more complete understanding of the present invention can be attained by considering the following detailed description in conjunction with the accompanying drawings.

DETAILED DESCRIPTION OF THE DRAWINGS

Figure 1:
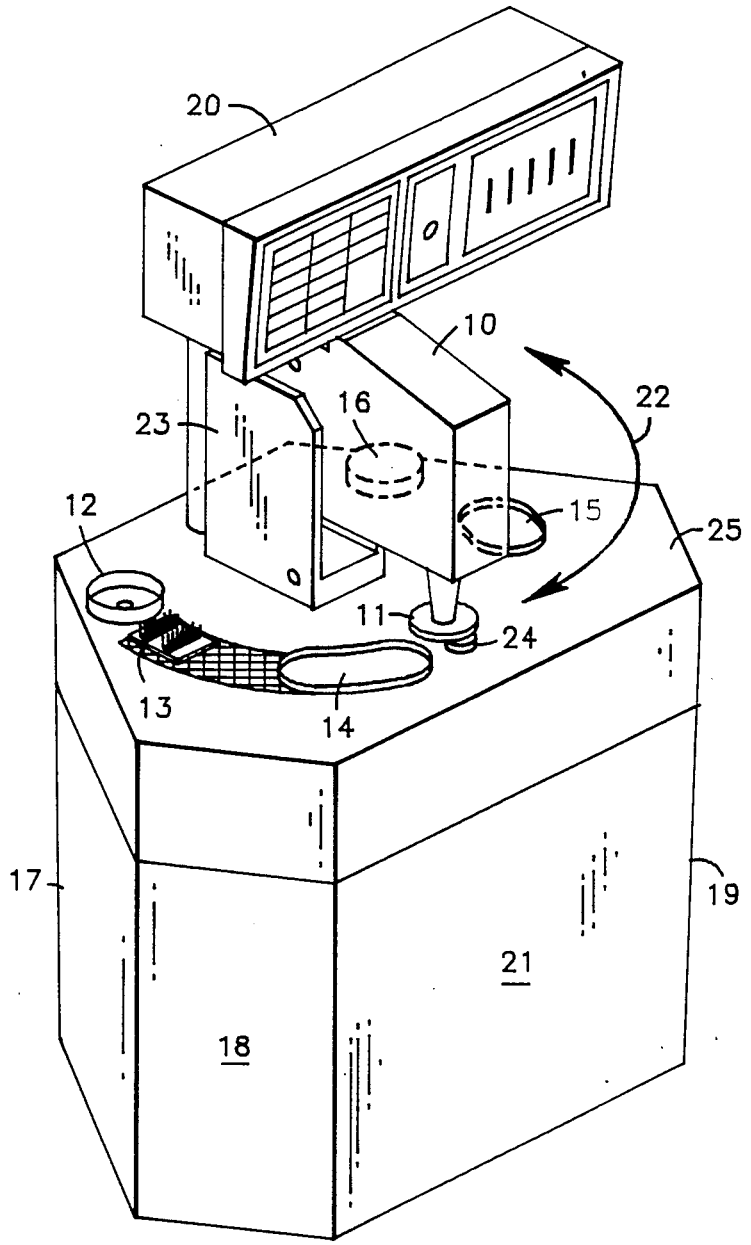
FIG. 1 illustrates an isometric view of a polishing apparatus.

FIG. 1 illustrates an isometric view of a friction polisher that automatically polishes semiconductor wafers or similar workpieces. Controlled by a computer, the polisher uses polishing arm 10 and wafer chuck 11 to move the wafer from station to station. These stations include load station 12, brush station 13, primary polish station 14, final polish station 15, and unload station 16. Stations 14 and 15 are openings in a removable cover which serves as work surface 25. Located below work surface 25 is a primary polish turntable and a final polish turntable. The turntables are described in greater detail hereinafter.

The major assemblies of the polisher include cabinet 17, fluid control (behind panel 18), quill speed control (behind panel 19), control box 20, polishing arm 10, and turntable drive 61 (behind panel 21). Arrow 22 represents the horizontal movement of polishing arm 10. Plate 23 is discussed in the description of FIG. 3.

The fluid control assembly, located behind panel 18, is a collection of 2-way and 3-way solenoid valves, $\frac{1}{4}$ and $\frac{3}{8}$ inch stainless steel tubing and various assorted fittings. The function of the fluid control assembly is to control vacuum, hot and cold deionized (D.I.) water, high pressure D.I. water (200 P.S.I.), and primary and final slurry as directed by control box 20. Vacuum is used in polishing arm 10 to attach a semiconductor wafer to wafer chuck 11. Hot water is used at primary polish station 14 and final polish station 15 to rinse off the wafer and polishing pad. The polishing pads are described in greater detail hereinafter. Cold D.I. water is used in load station 12, primary polish station 14, final polish station 15, and unload station 16. Cold D.I. water is also used in wafer chuck 11 to clean the backside of a wafer while in load station 12, and to fill the vacuum line in order to release the wafer at unload station 15. High pressure water is used in water jets that are used for cleaning the primary and final polishing pads. The water jets are stainless steel tubes that swing out over the polishing pads at a controlled rate. A typical primary slurry is a mixture of Tizox 1300 and D.I. water and a typical final slurry is a mixture of Nalco 2355 and D.I. water. The slurrys are directed to the center of each of their respected pads.

Quill speed control is located behind panel 19 and is used to regulate the turning speed of wafer chuck 11. The quill is another name for the shaft that supports wafer chuck 11. In this invention, it is desirable that wafer chuck 11 rotates at the same speed as the primary and final polishing pads. However, in a preferred embodiment, the two pads do not operate at the same RPM. The quill speed is controlled by control box 20 which regulates a D C motor.

Also illustrated in FIG. 1 is leveling station 24. Leveling station 24 is used for mounting wafer chuck 11 perpendicular to quill shaft 45.

Figure 2:
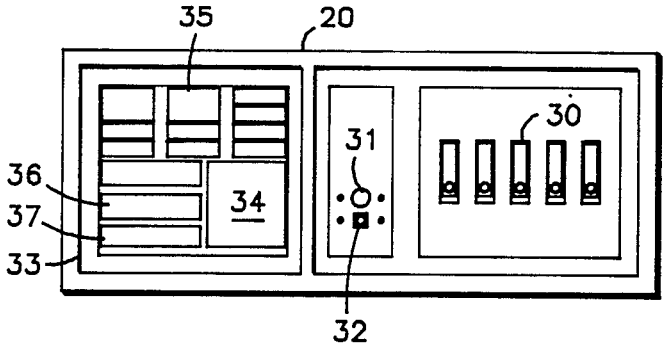
FIG. 2 illustrates a front view of a control box for the apparatus of FIG. 1.

Control box 20 is shown in greater detail in FIG. 2. Flowmeters 30 are used to control the amount of flow of hot D.I. water, cold D.I. water and polishing slurry for the primary and final polishing pads.

Located next to flowmeters 30 are sonic alarm 31 and key lock 32. Alarm 31 is used to advise an operator of a malfunction and lock 32 is used to prevent unauthorized personnel from changing programs.

To the left of alarm 31 is display and switch assembly 33, which is used to program a microcomputer located within control box 20. Assembly 33 has active keypad 34, function callout 35, system status lights 36 and display window 37. Function callout 35 is used as a reference index for the various functions that can be programmed through active keypad 34. System status lights 36 indicate high/low limits reached and wafer location. Display window 37 is a liquid crystal display (L.C.D.) which allows the function and default values to be displayed. The default values are values such as wafer diameter, polishing times, oscillation percentage, polishing arm pressures, and acceleration.

Display window 37 continuously shows thirteen basic parameters the polisher is using. Display window 37, in conjunction with keypad 34 can be used to display and/or modify any of the default parameters.

Located behind switch assembly 33 is a Motorola MC6809 microprocessor unit (MPU) and additional support electronics. The MPU is used to control and monitor all parameters throughout the polishing process.

The computer program has "smart" reactions to various failure modes such as, loss of slurries, wafer loss, and wafers in or out of proper position in pick up or discharge pockets. Also, the MPU controls wafer shape and flatness by the amount of oscillation, and acceleration factors of that oscillation during the primary polishing cycle. Oscillation is the stroke length of polishing arm 10, variations of which will cause the wafer flatness to go plus or minus. Acceleration is the rate of speed change at the end of each stroke. Behind flowmeters 30 are three motor driven pressure regulators (not shown) that are used to regulate a high, medium, and low pressure settings for polishing arm 10. The settings regulate how much force polishing arm 10 is applying against the polishing pads. The medium pressure setting is used to clean any dried slurry off of water chuck 11 which may have been formed during the polishing cycle. A high pressure is called for when polishing arm 10 has a wafer on wafer chuck 11 and is at primary polish station 14. This is when the majority of material is removed from the wafer or workpiece. After the wafer is deposited in unload station 16, polishing arm 10 moves to primary polishing station 14 and buffs chuck 11. The low pressure setting is used in the second half of the primary polishing cycle as part of a cool down cycle and is used again for the entire final polishing cycle. The pressure settings are monitored and adjusted by the MPU in control box 20.

Figure 3:
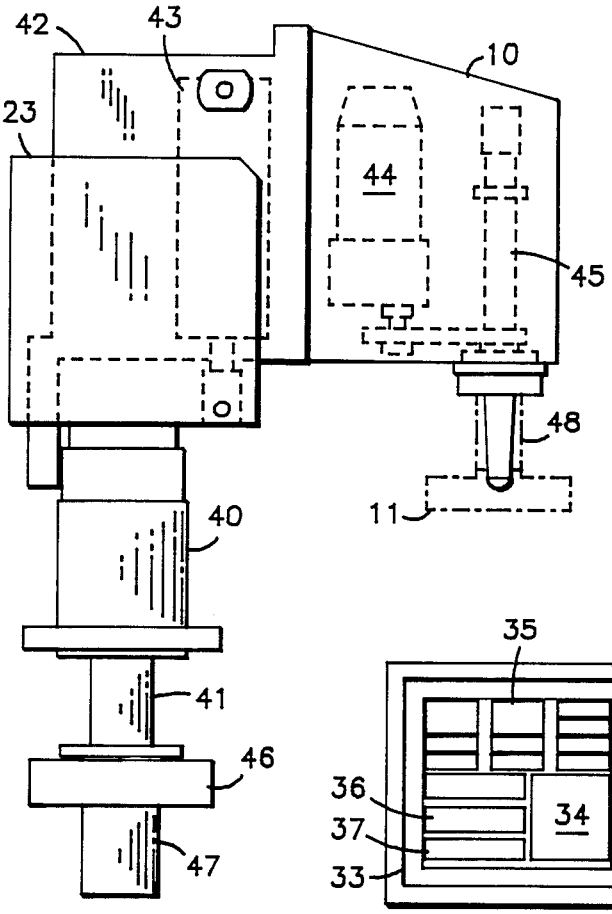
FIG. 3 illustrates a side view of a polishing arm and wafer chuck for the apparatus of FIG. 1.

Polishing arm 10 is shown in greater detail in FIG. 3. Polishing arm 10 is supported by bearings in housing 40 and speed reducer 46. Shaft 41 is connected to speed reducer 46 and servo motor 47 which rotate shaft 41 and subsequent polishing arm 10 through 240° of horizontal rotation. Positioned behind plate cover 42 is air cylinder 43 which has a 3¼ inch bore and a 6 inch stroke. One end of air cylinder 43 is mounted to the upper portion of polishing arm 10. The other end of cylinder 43 is mounted to plate 23. This allows polishing arm 10 to be guided by a precision linear bearing system and move 6 inches in the vertical plane. Plate 23 is also supported by bearing housing 40 and moves in the horizontal plane but not the vertical plane. Also located inside polishing arm 10 is quill drive motor 44 and quill shaft 45. Quill motor 44 should be a minimum of ⅛ HP D.C. and variable speed to match turntable speeds, for example 300 RPM, and programmed by control box 20 to change speeds between primary and final polishing operations. The quill bearing assembly has some angular adjustments from a vertical position and is then lockable in the desired position. Quill shaft 45 does not run perpendicular to the turntable, in the preferred embodiment quill shaft 45 is slightly less than 1 degree from perpendicular. The quill housing is built so that angles can be adjusted. One advantage to offsetting the angle of quill shaft 45 is that a smaller size quill motor 44 can be used. When quill shaft 45 and attached wafer chuck 11 make contact with a polishing pad, the pads rotational movement helps drive wafer chuck 11 in a circular motion.

Figure 4:
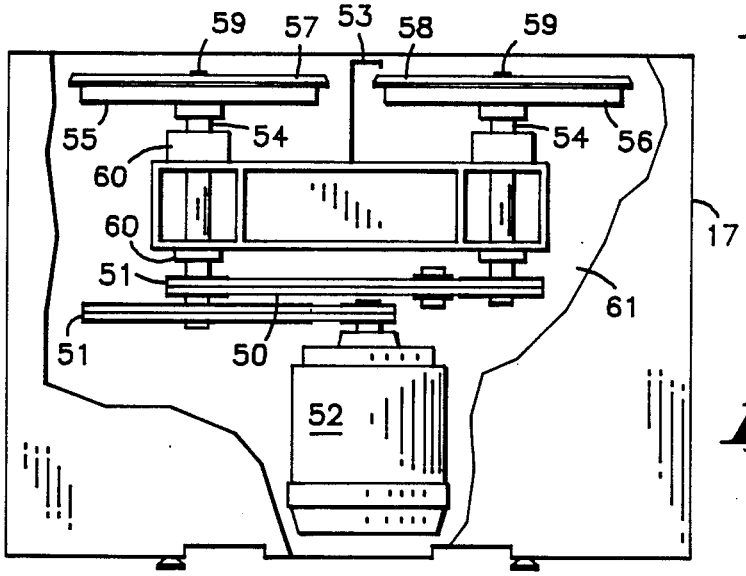
FIG. 4 illustrates a view of a turntable drive assembly for the apparatus of FIG. 1.

Wafer chuck 11 is attached to quill shaft 45 by neoprene hose 48. The end of quill shaft 45 is rounded and fits into a matching recess in wafer chuck 11. Hose 48 follows wafer chuck 11 a small degree of swivel movement but prevents any rotational slippage between shaft 45 and chuck 11. FIG. 4 illustrates a detailed view of turntable drive 61 enclosed in cabinet 17. Using belts 50 and sheaves 51, main drive motor 52 is used to turn drive shafts 54 which are bolted to primary turntable 55 and final turntable 56. Pad plates 57 and 58 are fastened to turntables 55 and 56 by bolts 59. Semisoft drive pins (not shown) are used between pad plates 57,58, and turntables 55,56, to prevent the pad plates from slipping on the turntables. Pad plates 57,58, are made of aluminum 22 millimeters (mm) thick and a diameter of 559 mm and 527 mm, respectively. Pad material for pad plate 57 is typically polyurethane foam with a porous texture such as Rhoads LP57. Pad material for pad plate 58 is a polyurethane impregnated fabric with a smooth texture such as Rodel 205. An adhesive is used to fasten the pad material to the pad plates.

Turntables 55,56, are electroless nickel plated cast iron, and normalized for stability. Turntables 55,56, in a preferred embodiment have an outside diameter of approximately 508 mm and are flat within ±0.025 mm across the diameter.

Turntables 55,56, are rigidly supported by bearing system 60 and can operate smoothly at approximately 300 R.P.M. continuously at up to 454.5 kilogram (kg) thrust loading plus radial loading produced by the 454.5 kg thrust load at 178 mm from center of rotation. This off-center loading will always be at the same position. It is estimated that the temperature of turntables 55,56, drive shafts 54 and bearings 60 will be about 344 K. Bearing clearances and lubrication must accommodate these temperatures continuously.

Primary turntable 55 speed is about 300 R.P.M. Final turntable 56 speed is about 230 R.P.M. Drive motor 52 is a 7.5 HP high efficiency 3 phase 1200 R.P.M. motor with direct belt drive 50 and reduction to turntables 55 and 56. Both turntables 55,56, rotate in the same direction, counter-clock-wise (CCW). Final turntable 56 is operated at 77% of of table-speed of primary turntable 55.

Primary and final slurry is delivered to the polishing pads through stainless steel tubes 25 mm off the center of the tables. This allows for clearance for gasketed hold down bolt 59 in the center. The steel tubes 53 will also feed rinse water to the pads. The slurry-rinse lines are pivoted so that they can swing clear of the table for a pad change.

Figure 5:
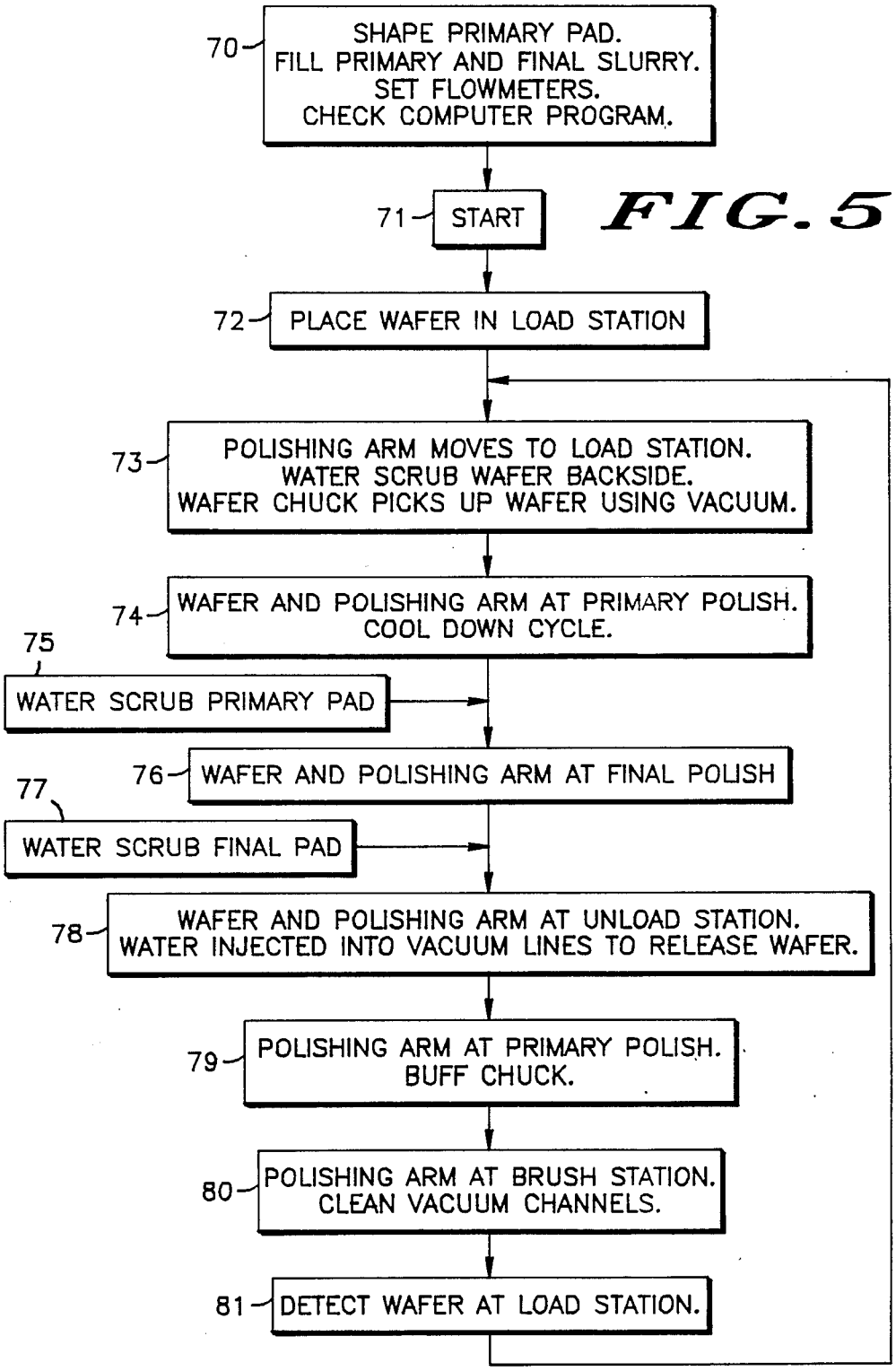
FIG. 5 illustrates an operational flow diagram useful in understanding the operation of the polishing apparatus.

An operational flow diagram is illustrated in FIG. 5 that represents the steps used to polish a wafer in this invention. This will provide a clearer understanding of the novelties of the invention and show how the system works.

Block 70 represents the preparation that is needed before the polisher is turned on. In keeping the thickness and mass of the turntable down it was realized that the downward force of polishing arm 10 would cause turntable 55 to flex to some degree. In order to maintain parallelism in a wafer and compensate for the flexing turntable, it was determined that the primary polishing pad must be shaped before it is used to polish wafers. Only the primary pad is shaped because it is here that the majority of damaged material is removed, and the highest downward pressure is applied from polishing arm 10. The shaping of the pad is accomplished by replacing wafer chuck 11 with a special abrasive chuck. After shaping, the center of the pad is 0.09 millimeters lower than the outer edge. This shape will produce very flat 76 mm to 150 mm wafers. Also checked or filled at this time are the primary and final slurry solutions, the settings for flowmeters 30, and the computer program in control box 20. The program is checked for proper wafer size, pressures and times.

Block 71 represents the start of the electrical and mechanical operation of the polisher. The "start" button is located on control box 20.

Block 72 represents the manual placing of a wafer into loadstation 12.

Block 73 represents the loading or obtaining of a wafer by wafer chuck 11 from load station 12. Load station 12 is designed to be easily changeable for different size wafers. Incorporated into the bottom of load station 12 is a fiber optic sensor, which is used to signal polishing arm 10 that a wafer is ready for pickup. Wafer chuck 11, which is attached to polishing arm 10, subjects a wafer to a vacuum which is used to hold the wafer to wafer chuck 11. Prior to picking up a wafer, jets of water from chuck 11 scrub the backside of the wafer to remove particulates that might be present. The reason for this was that any particles trapped behind the wafer would "telegraph" a defect to the front of the wafer.

Once the wafer is attached to chuck 11, polishing arm 10 rotates until it is over primary polish station 14. This is represented by block 74. Air cylinder 43 causes polishing arm 10 to drop down and make contact with the pad material on pad plate 57. Pad plate 57 is fastened to turntable 55 which is turning at approximately 300 RPM. Wafer chuck 11 is also turning at 300 RPM and polishing arm 10 is oscillating from 1 to 4 inches depending on wafer size. As the turntable turns, primary slurry is being deposited to the center of the polishing pad. It is at this step that the majority of material is removed form the wafer. The second part of the primary polish cycle is the cool down cycle. Instead of slurry, cold water is deposited to the center of the polish pad. Also, the downward pressure of polishing arm 10 is changed from "high" to "low". At the completion of the cool down cycle, polishing arm 10 rotates to final polish station 15 as represented by block 76. When polishing arm 10 has cleared station 14, a high pressure water jet (200 PSI) 53 slowly moves across the polish pad at 229 mm per minute, scrubbing off any residue. This is represented by block 75.

Final polish turntable 56 is turning at approximately 230 RPM. The quill speed control (located behind panel 19) signals control box 20 which in turn signals quill motor 44 to match the speed of turntable 56. This results in wafer chuck 11 turning the same speed as turntable 56. Besides running at a slower RPM, the final polish cycle uses a "final slurry" and a "low" pressure setting on polishing arm 10.

At the completion of the polishing cycle, the wafer is unloaded in to station 16 which is represented by block 78. At this time, final polish station 15 is cleaned by a high pressure water jet as represented by block 77. Like load station 12, unload station 16 is easily changeable for different size wafers. Also unload station 16 has a fiber optic sensor to detect wafers at that station. If there is a wafer in station 16 and polishing arm 10 has completed the polishing cycle with another wafer, it will hold that wafer at final polish station 15 until unload station 16 is clear. When placed on hold, station 15 is dispensing only cold water instead of slurry. This prevents the unwanted removal of additional material from the wafer.

Once polishing arm 10 has dropped off its wafer at unload station 16, it repositions itself over primary polish station 14. Using the "medium" pressure setting, polishing arm 10 drops down on the primary polishing pad and buffs wafer chuck 11. This is represented by block 79. The purpose of the buffing is to remove any dried slurry that might be remaining on wafer chuck 11.

After wafer chuck 11 is buffed, polishing arm 10 moves to brush station 13, which is represented by block 80. At station 13, the vacuum channels that are in wafer chuck 11 are cleaned out by simultaneously rotating chuck 11 against the brushes and blowing water out the opening in the chuck.

If polishing arm 10 detects another wafer in load station 12, it will then repeat the cycle. This is represented by block 81.

Thus it is apparent that there has been provided an improved apparatus for polishing semiconductor material. The resulting device is a computer controlled friction polisher that can automatically do both the primary polish and the final polish and obtain ultra-flat wafers with less breakage and defects. This is accomplished in part with the use of cleaning devices such as water scrubbing the back of the wafer, water jets on the polishing pads, buffing the wafer chuck and brush scrubbing the wafer chuck. In addition, operator error is reduced due to the use of the MPU which automatically sets pressures, oscillation, acceleration, times, etc., when the operator enters the size of the wafer to be polished.

What is claimed is:

1. Apparatus for polishing semiconductor wafers having at least first and second turntables and a polishing arm for moving the wafers from one location to another, comprising: a wafer chuck mounted to the polishing arm for picking up a semiconductor wafer, the wafer chuck having capability to dispense water to rinse the wafer before pick up and to use a vacuum to pick up the wafer; a leveling station mounted on the apparatus to assist mounting the wafer chuck in a predetermined orientation; first and second polishing pads mounted on the first and second turntables, respectively, the first polishing pad having a predetermined shape to receive the wafer for primary polishing; and at least one high pressure water jet mounted adjacent the turntables to clean the polishing pads after a polishing operation wherein the wafer chuck is mounted on a shaft which is at a small angle from perpendicular to the turntables and the leveling station serves to assist mounting the wafer chuck perpendicular to the shaft.

2. Apparatus for polishing semiconductor wafers having at least first and second turntables and a polishing arm for moving the wafers from one location to another, comprising: a wafer chuck mounted to the polishing arm for picking up a semiconductor wafer, the wafer chuck having capability to dispense water to rinse the wafer before pick up and to use a vacuum to pick up the wafer; a leveling station mounted on the apparatus to assist mounting the wafer chuck in a predetermined orientation; first and second polishing pads mounted on the first and second turntables, respectively, the first polishing pad having a predetermined shape to receive the wafer for primary polishing; and at least one high pressure water jet mounted adjacent the turntable to clean the polishing pads after a polishing operation, wherein the first polishing pad's predetermined shape is to compensate for flexing of the first turntable during the primary polishing operation.

3. A method for polishing a semiconductor wafer comprising: shaping a primary polishing pad to compensate for flexing of a turntable on which the primary polishing pad is mounted; rinsing the backside of a wafer just prior to picking up the wafer for polishing; picking up the rinsed off wafer with a chuck having a vacuum pick up; placing the wafer on the primary polishing pad; applying a polishing slurry to the primary polishing pad and rotating the polishing pad to polish the wafers; varying by computer control the stoke length and acceleration at the end of each stroke of a control arm holding the chuck to control flatness of the wafer being polished; moving the wafer to a second polishing pad to accomplish final polishing of the wafer; moving the wafer to an unload station so the wafer can be unloaded from the chuck; using a high pressure jet to clean off the polishing pads following the use of each pad by slowly moving a high pressure water jet across the polishing pad; and cleaning the chuck on a brush before picking up another wafer to be polished.

4. The method of claim 3 wherein the shaping of the primary polishing pad is accomplished by using an abrasive chuck.

5. The method of claim 3 wherein the polishing pads are cleaned by slowly moving the high pressure water jet at 229 mm per minute.

6. The method of claim 3 further including mounting the chuck at a slight angle from being perpendicular to the polishing pads.

* * * * *